US006448885B1

(12) United States Patent
Abe et al.

(10) Patent No.: US 6,448,885 B1
(45) **Date of Patent: *Sep. 10, 2002**

(54) MESSAGE RECEIVING APPARATUS AND A METHOD OF RECEIVING A MESSAGE

(75) Inventors: Yasushi Abe; Kazunori Watanabe, both of Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/531,651

(22) Filed: Mar. 21, 2000

Related U.S. Application Data

(62) Division of application No. 09/003,758, filed on Jan. 7, 1998, now Pat. No. 6,060,999.

(30) Foreign Application Priority Data

Jan. 10, 1997 (JP) ..... 9-013214

(51) Int. Cl.[7] ..... G08B 5/22

(52) U.S. Cl. ..... 340/7.58; 340/7.55; 340/7.6; 340/7.45; 455/412

(58) Field of Search ..... 340/7.58, 7.55, 340/7.6, 7.45; 455/412

(56) References Cited

U.S. PATENT DOCUMENTS

| | | | | | |
|---|---|---|---|---|---|
| 5,192,947 | A | * | 3/1993 | Neustin | 340/825.44 |
| 5,206,855 | A | * | 4/1993 | Schwendeman et al. | 370/311 |
| 5,262,769 | A | * | 11/1993 | Holmes | 340/825.03 |
| 5,285,496 | A | * | 2/1994 | Frank et al. | 380/9 |
| 5,394,140 | A | * | 2/1995 | Wong et al. | 340/825.44 |
| 5,668,852 | A | * | 9/1997 | Holmes | 455/31.2 |
| 5,892,457 | A | * | 4/1999 | Kim | 340/825.48 |
| 5,896,096 | A | * | 4/1999 | Kim | 340/825.46 |
| 6,060,999 | A | * | 5/2000 | Abe et al. | 340/7.6 |

* cited by examiner

*Primary Examiner*—Michael Horabik
*Assistant Examiner*—Yves Dalencourt
(74) *Attorney, Agent, or Firm*—Connolly Bove Lodge & Hutz LLP

(57) ABSTRACT

A transmitted signal including a message and address data is received. A plurality of sets of assigned address data is stored. A received message is stored when an address data in a received transmitted signal agrees with any of the stored assigned address data sets. A user is alerted when a command signal causes the message to be read from storage. A counter counts the number of times the message is received when the address data in the received transmitted signal agrees with one of the assigned address data sets. The count is compared to a reference. An alarm issues when the count exceeds the reference.

12 Claims, 9 Drawing Sheets

MEMORY
3
1a
1
RECEIVING CKT
2
DECODER
2a
CLK CKT
8
OP CKT
4
CPU
4a
RAM
4q
TIMER
5
BUFFER
6
DRIVER
7
DISPLAY
4b
DISP STEP
4j
MESSAGE DET & STORING OP
4k
THE NO. OF MESSAGES DET OP
4ℓ
CONT CODE INPUT OP
4m
REF INPUT OP
4n
COMP OP
4h
ALARMING TIMING INPUT OP
4i
ALARMING TIMING COMP OP
4g
ALARMING OP
107 ROM
SPEAKER
10
9
DRIVER
11
DRIVER
12
VIBRATOR

MESSAGE RECEIVING APPARATUS AND A METHOD OF RECEIVING A MESSAGE

This application is a divisional application of U.S. patent application Ser. No. 09/003,758, filed Jan. 7, 1998 now U.S. Pat. No. 6,060,999, now allowed.

BACKGROUND OF THE INVENTION

1. Field of the Invention

This invention relates to a pager for receiving a message included in a transmitted paging signal directed to the pager and to a method of receiving a message with controllable alarming.

2. Description of the Prior Art

A pager for receiving a message included in a transmitted paging signal directed to the pager is known. When such a prior art pager detects an address signal directed thereto in the wireless reception signal, the pager informs the user of reception by sounding an alarming sound or making vibrations, analyzes the message signal following the address signal, and displays the message.

The prior wireless pager includes a memory for storing its address and compares its address read from the memory with the address signal included in the wireless reception signal to detect the reception signal directed to itself.

In the wireless paging system, a service for providing a plurality of addresses to one wireless pager is provided. In this case, the user of the wireless pager can know the sender by checking the address used.

FIG. 9 is a block diagram of a prior art pager.

This prior art pager comprises a receiving circuit 21 for receiving a wireless signal transmitted from a base station of the wireless paging system by an antenna 21*a* and demodulating it to output a digital signal, and a decoder 22 for effecting a bit synchronizing and an error correction to the reception signal converted into the digital signal and comparing the address in the reception signal with its own address written in a memory 23. The pager further comprises a CPU (Central Processing Unit) 24 including an EEPROM (Electrically Erasable Programmable Read Only Memory) and a RAM 24*a* for temporary storing the message data included in the reception signal outputted from the decoder 22. The pager further includes a display buffer 25 for temporally storing a display signal generated from the message data, and a display driver 26 for driving a display 27 on the basis of the display signal stored in the display buffer 25, the display 27 for displaying an image corresponding to the display signal by a liquid crystal element. The pager further comprises a speaker driving circuit 29 for sounding a speaker 30 to generate an alarm sound, a vibrator driving circuit 31 for operating the vibrator 32, and a switch circuit 28 for generating commands or various data corresponding to the operations of the user, wherein the signal from the switch circuit 28 is inputted to the CPU 24 through the decoder 22.

Next, an operation of the prior art pager will be described. The receiving circuit 21 receives the wireless paging signal transmitted from the base station (not shown) of the wireless paging system by the antenna 21*a* and converts it into the digital signal through amplifying, frequency-converting, detecting, and demodulating and supplies the digital signal to the decoder 22.

The decoder 22 effects the bit synchronizing processing and the error correction processing to the digital signal from the receiving portion 21, and then, it confirms that the reception signal is directed to itself by comparing its own address read from the memory portion 23 via the CPU 24 with the address included in the reception signal. If the reception signal is directed thereto, and it includes message data, the decoder 22 obtains the message data and supplies the message data to the CPU 24 and outputs a drive signal to the speaker driving circuit 29 or the vibrator driving circuit 31. The speaker driving circuit 29 generates the alarm sound in response to the input of the driving signal. If the alarm operation by the vibrator 32 is set, the decoder 22 supplies the drive signal only to the vibrator driving circuit 31.

The CPU 24 stores the message data from the decoder 22 in the RAM 24*a* and converts the message data into display data and supplies it to the display buffer 25. The display driver 26 displays the message on the display 27.

As mentioned, the prior art pager receives the wireless paging signal transmitted from the base station and effects the alarming operation by the speaker 30 or the vibrator 31 and displays the message on the display 27.

SUMMARY OF THE INVENTION

The aim of the present invention is to provide an improved pager and an improved method of receiving messages, According to the present invention there is provided a first pager (message recieving appartus) which includes: a receiving circuit for receiving a transmitted paging signal including a message and address data; a message receiving circuit responsive to the receiving circuit, having an address memory for storing a plurality of sets of assigned address data and a message memory, for receiving and storing the message from the receiving circuit in the message memory when the address data in the recieving paging signal agrees with any of the plurality of sets of assigned address data. The pager further includes a message informing circuit responsive to a command signal for reading the message from the message memory and informing an operator of the read message; a counting circuit for counting the number of times of receiving a message when the address data in the recieving paging signal agrees with one of the plurality of sets of assigned address data; a comparing circuit responsive to the counting circuit for comparing the number of times with a reference; and an alarming circuit for effecting an alarming operation on the basis of the result of the comparing circuit.

In the first pager, the alarming circuit effects the alarming operation when the number of times is equal to or higher than the reference.

The first pager may further include a time signal generation circuit for generating a time signal indicative of the present time and a timing detection circuit for detecting that the present time agrees with a predetermined time, wherein the alarming circuit effects the alarming operation on the basis of the result of the comparing circuit and the result of the timing detection circuit.

According to the present invention there is provided a second pager (message recieving appartus) which includes: a receiving circuit for receiving a transmitted paging signal including a message and address data, the message including a control code indicative of a kind of the message; and a message receiving circuit responsive to the receiving circuit, having address memory for storing assigned address data and message memory, for receiving and storing the message from the receiving circuit in the message memory when the address data in the paging signal agrees with the assigned address data. The second pager further includes a control code detection circuit for detecting the control code from the message from the received message; a message informing circuit responsive to a command signal for reading the message from the message memory and informing an operator of the read message; a counting circuit responsive to the message receiving circuit for counting the number of times of receiving the message which includes the detected control code agreeing with a predetermined control code; a comparing circuit responsive to the counting circuit for comparing the number of times with a reference; and an alarming circuit for effecting an alarming operation on the basis of the result of the comparing circuit.

In the second pager, the alarming circuit effects the alarming operation when the number of times is equal to or higher than the reference. In this case, the second pager may further include a time signal generation circuit for generating a time signal indicative of the present time and a timing detection circuit for detecting that the present time agrees with a predetermined time, wherein the alarming circuit effects the alarming operation on the basis of the result of the comparing circuit and the result of the timing detection circuit.

According to the present invention there is also provided a first method of receiving a message from a transmitted paging signal, which includes the steps of: (a) providing an address memory for storing a plurality of sets of assigned address data and a message memory; (b) receiving a transmitted paging signal including a message and address data of the message; (c) receiving and storing the message from the received paging signal in the message memory when the address data in the recieved paging signal agrees with any of the plurality sets of assigned address data in response to the step (b); (d) reading the message from the message memory and informing an operator of the read message in response to a command signal; (e) counting the number of times of receiving the message when the address data of the message agrees with one of the plurality of sets of assigned address data; (f) comparing the number of times with a reference in response to the step (e); and (g) effecting an alarming operation on the basis of the result in step (f).

In the first method, the alarming operation is effected when the number of times is equal to or higher than the reference.

The first method may further include the steps of: (h) generating a time signal indicative of the present time; and (i) detecting that the present time agrees with a predetermined time, wherein the alarming operation is effected on the basis of the result of the step (f) and the result of step (i).

According to the present invention there is further provided a second method of receiving a message from a transmitted signal, which includes the steps of: (a) providing an address memory for storing assigned address data and a message memory; (b) receiving a transmitted paging signal including a message and address data of the message, the message including a control code indicative of a kind of the message; (c) receiving and storing the message from the received paging signal in the message memory when the address data of the message agrees with the assigned address data in response to the step (b); (d) detecting the control code from the message; (e) reading the message from the message memory and informing an operator of the read message in response to a command signal; (f) counting the number of times of receiving the message which includes the detected control code agreeing with a predetermined control code; (g) comparing the number of times with a reference in response to the step (f); and (h) effecting an alarming operation on the basis of the result in step (g).

In the second method, the alarming operation is effected when the number of times is equal to or higher than the reference.

The second method may further include the steps of: (i) generating a time signal indicative of the present time; and (j) detecting that the present time agrees with a predetermined time, wherein the alarming operation is effected on the basis of the result of the step (g) and the result of the step (j).

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION (First Embodiment)

In the first embodiment, a pager (message recieving appartus) has a plurality of addresses assigned thereto and at least one address is used for broadcasted information showing a low degree of immediateness or priority.

Figure 1:
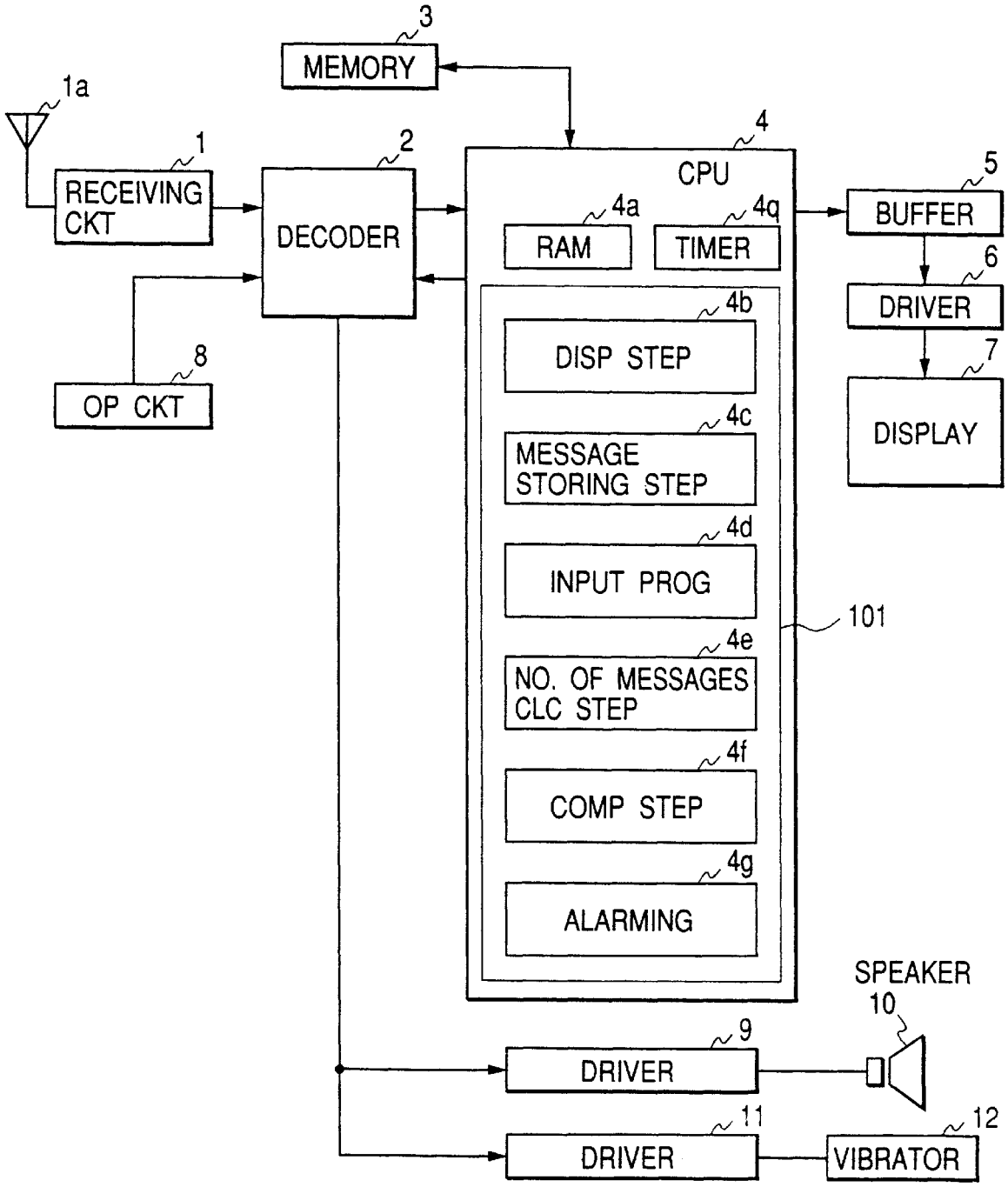
FIG. 1 is a block diagram of a pager of a first embodiment.

FIG. 1 is a block diagram of the pager of the first embodiment. The pager of the first embodiment comprises a receiving circuit 1 for receiving a paging (message) signal transmitted from a base station (not shown) of the wireless paging system by an antenna 1*a* and demodulating it to output a digital signal, a decoder 2 for effecting a bit synchronizing and an error correction to the reception signal converted into the digital signal and comparing the addresses in the reception signal with the assigned address stored in a memory 3, a CPU (Central Processing Unit) 4 including a RAM 4*a* for temporarily storing the message data included in the reception signal outputted from the decoder 2, a display buffer 5 for temporarily storing a display signal generated from the message data, a display driver 6 for driving the display 7 on the basis of the display signal stored in the display buffer 5, the display 7 for displaying the message by a liquid crystal element, a speaker driving circuit 9 for sounding a speaker 10 to generate an alarm sound, a vibrator driving circuit 11 for driving the vibrator 12, and an operation circuit 8 for generating commands or various data corresponding to the operations of the user, wherein the signal from the operation circuit 8 is inputted to the CPU 4 through the decoder 2. The decoder comprises a DSP (digital signal processor) which is designed so as to perform a plurality of functions such as the bit synchronizing, the error correction, message extracting using the assigned address, controlling the speaker 10 and the vibrator 12 in cooperation with the CPU 4 in addition to the decoding.

Moreover, the CPU 4 further comprises a timer 4*q* and a ROM (Read Only Memory) 101 for storing various processing steps or programs such as a message storing step 4*c* for storing the message data into the RAM 4*a,* a display step 4*b* for converting the message data stored in the RAM 4*a* to a display signal and supplying the display signal to the display buffer 5, an input program 4*d* for inputting one of its address (specified address) to which a message showing a low degree of immediateness or priority is sent and inputting a reference value m for comparing the number of the messages stored in the specified address to set the controllable incoming alarming operation, the number-of-messages detecting step 4*e* for detecting the number of messages to the specified address of the RAM 4*a,* a comparing step 4*f* for comparing the number of messages to the specified address stored in the RAM 4*a* with the reference value m inputted by the inputting program 4*d,* an alarming step 4*g* for effecting an alarming operation by controlling the display portion 7, the speaker 10, or the vibrator 12.

Next, an operation of the pager of the first embodiment will be described.

The receiving circuit 21 receives the paging signal transmitted from the base station (not shown) of the wireless paging system by the antenna 1*a* and converts it into the digital signal through amplifying, frequency-converting, detecting, and demodulating and supplies the digital signal to the decoder 2.

The decoder 2 effects the bit synchronizing processing and the error correction processing to the digital signal from the receiving circuit 1, and then, it confirms that the reception signal is directed to itself by comparing its own addresses read from the memory 3 via the CPU 4 with the address included in the reception signal. If the reception signal is directed thereto, it includes message data, and the controllable alarming operation is not set to the address, the decoder 2 obtains the message data and supplies the message data to the CPU 4 and outputs a drive signal to the speaker driving circuit 9 or the vibrator driving circuit 31. The speaker driving circuit 9 generates the alarm sound in response to the input of the driving signal. If the alarm operation by the vibrator 12 is set, the decoder 2 supplies the drive signal only to the vibrator driving circuit 11.

The CPU 4 stores the message data from the decoder 2 in the RAM 4*a* and converts the message data into display data and supplies it to the display buffer 5. The display driver 6 displays the message on the display portion 27.

As mentioned, if the message is directed to the address to which the controllable alarming operation is not set, the pager receives the paging signal transmitted from the base station and effects the alarming operation by the speaker 10 or the vibrator 12 and displaying the message on the display 7.

Next, the controllable (incoming message) alarming operation will be described.

Figure 2A:
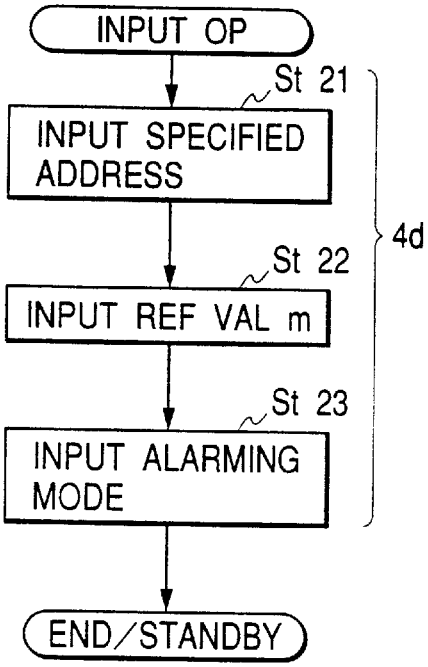
FIG. 2A depicts a flow chart of the first embodiment showing an alarming mode input operation.

FIG. 2A depicts a flow chart of an alarming mode input operation.

The CPU 4 receives input of the specified address from the operation circuit 8 operated by the user and stores the specified address in the RAM 4*a* in step st21. Messages sent to the specified address show a low degree of immediateness or priority. In the following step st22, the CPU 4 receives input of the reference value m and stores the reference value m in the RAM 4*a*. Then, the CPU 4 receives input of alarming mode with respect to the specified address in step st22. That is, the user can select one or more methods of the alarming, that is, by the speaker 10, by the vibrator 12, or by combination of the display 7, the speaker 10, and the vibrator 12 by operating the operation circuit 8.

Figure 2B:
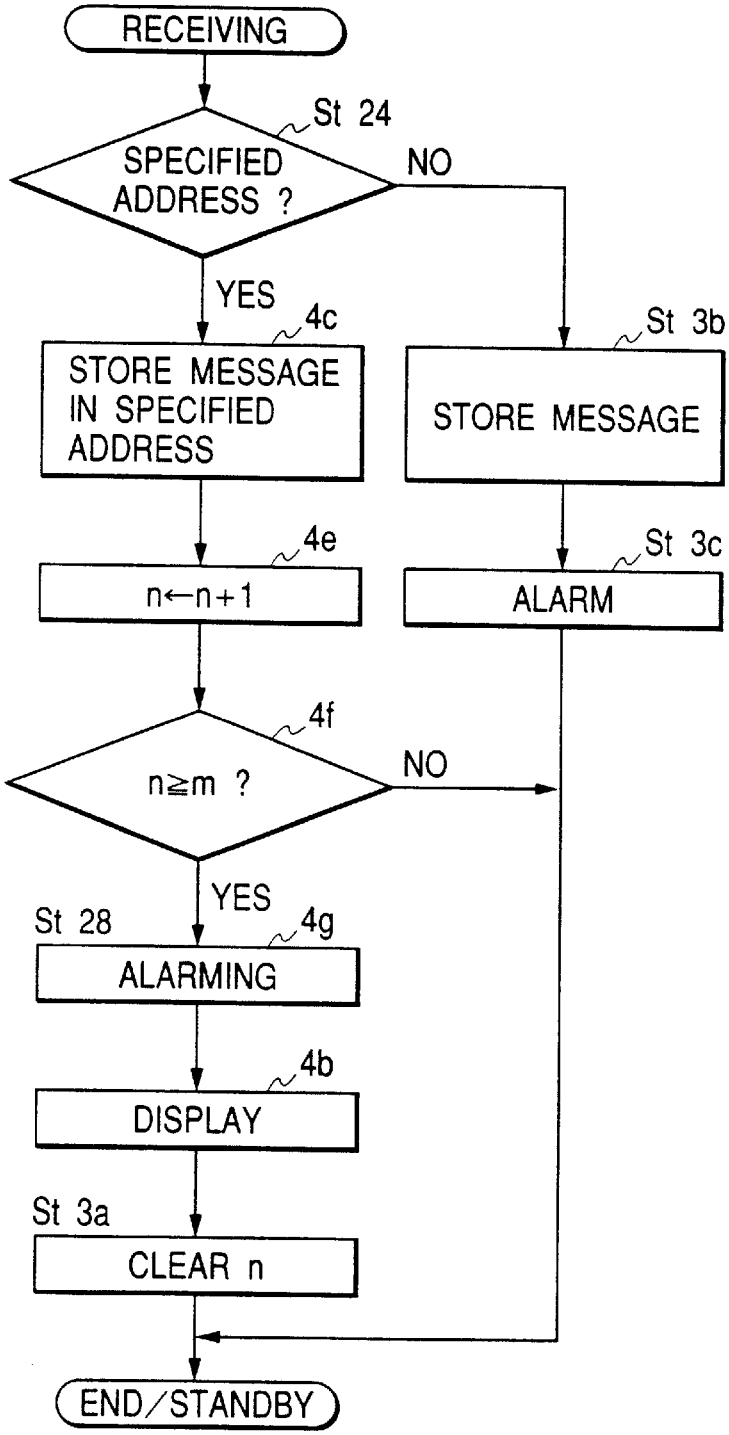
FIG. 2B depicts a flow chart of the first embodiment showing a receiving operation.

FIG. 2B depicts a flow chart of the first embodiment showing a receiving operation.

If the address in the reception signal agrees with one of the plurality of assigned address data and the decoded paging signal includes a message, the decoder 2 extracts the message data from the decoded paging signal and supplies the extracted message to the CPU 4.

The CPU 4 executes the receiving operation as shown in FIG. 2B.

The CPU 4 judges whether the address agrees with the specified address in step st24. If the address data disagrees with the specified address and there is a message in the reception signal, the CPU 4 stores the message at a message data storing area in the RAM 4*a* by the message storing step st3*c* and controls the decoder 2 to effect alarming in the alarming step st3*c*. The decoder 2 supplies a speaker control signal to the speaker drive circuit 9 or a vibrator control signal to the vibrator drive circuit 11. The speaker drive circuit 9 drives the speaker 10 in response to the speaker control signal to generate an alarm sound if the alarming operation by the speaker 10 has been set. The vibrator drive circuit 11 drives the vibrator 12 in response to the vibrator control signal to generate vibrations if the alarming operation by the vibrator 12 has been set. After the alarming step st3*c,* the pager moves to a standby mode.

In step st24, if the address data in the decoded paging signal agrees with the specified address, the CPU 4 executes the message storing step 4*c,* that is, the CPU 4 stores the message at a predetermined storing area of the RAM 4*a* corresponding to the specified address. Then, the CPU 4 increments the number of messages directed to the specified address in a calculation step 4*e,* that is, the CPU 4 increases the number of the messages directed to the specified address by one.

In the following step 4*f,* the CPU 4 compares the number n of the messages directed to the specified address with the inputted reference m stored in the RAM 4*a*. If the number n of the messages directed to the specified address is lower than the reference m, the CPU 4 moves to the standby operation without the informing operation.

In step 4*f,* if the number n of the messages directed to the specified address is equal to or higher than the reference m, the CPU 4 executes the alarming operation in step 4*g,* that is, the CPU 4 executes the alarming operation in the mode determined in step st23. Moreover, the CPU 4 starts the timer 4*q*.

In the following step 4*b,* the CPU 4 executes the display operation, that is, when the predetermined time interval for alarming expires in the timer 4*q,* or the CPU 4 receives the display command from the operation circuit 8, the CPU 4 converts the message data directed to the specified address into the display data and supplies the display data to the display 7. If there are a plurality of messages which have not been displayed to inform the user, the user can view all of messages directed to the specified address in response to a scroll command from the operation circuit 8. In step st3*a,* the CPU 4 clears the number n of the messages directed to the specified address and moves to the standby mode.

As mentioned, if the pager according to the first embodiment receives the messages showing a low degree of immediateness or priority, a degree of the troublesomeness in responding to every alarming can be reduced. Moreover, erasing of old message stored in the RAM 4*a* by storing a new message over the old message is prevented because of the alarming operation 4*g* controlled by the counting operation st26 and the comparing operation 4*f.*

(Second Embodiment)

Figure 3:
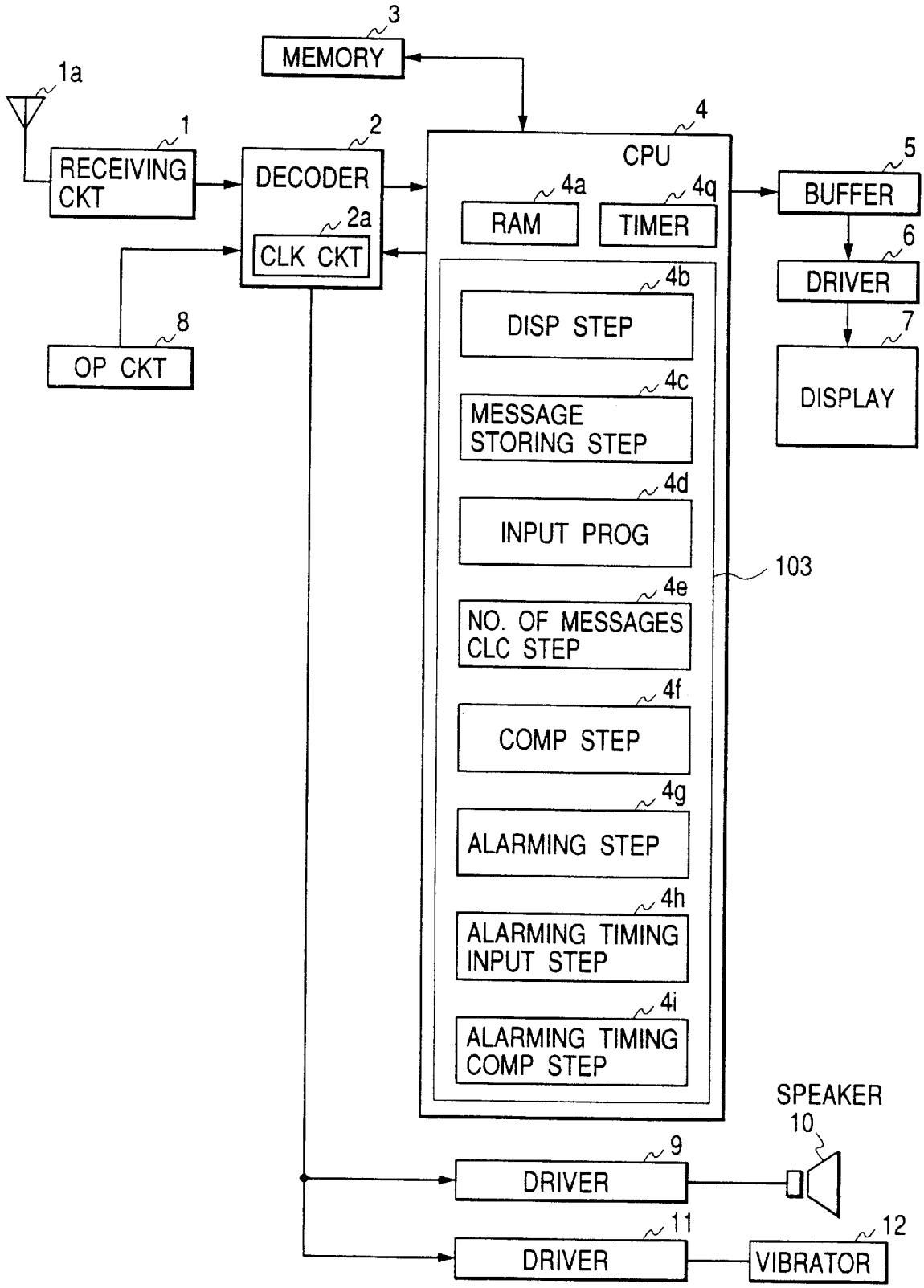
FIG. 3 is a block diagram of a pager of a second embodiment.

FIG. 3 is a block diagram of a pager of a second embodiment.

A pager of the second embodiment has substantially the same structure as that of the first embodiment. The difference is that processing for a timing control of the alarming are further provided. That is, a clock circuit 2*a* is further provided to the decoder 2 and an alarming timing input step 4*h* and an alarming timing comparing step 41 are further provided in the ROM 103 in the CPU 4.

Next, the controllable incoming alarming operation will be described.

Figure 4A:
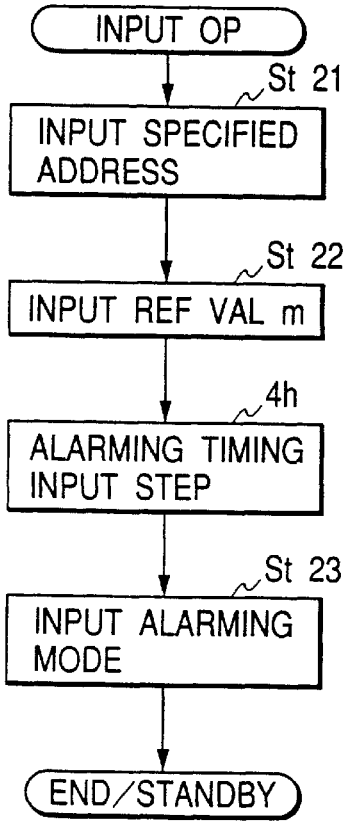
FIG. 4A depicts a flow chart of the second embodiment showing an alarming mode input operation.

FIG. 4A depicts a flow chart of the second embodiment showing an alarming mode inputting operation.

The CPU 4 receives input of the specified address from the operation circuit 8 operated by the user and stores the specified address in the RAM 4*a* in step st21. Messages sent to the specified address show a low degree of immediateness or priority. In the following step st22, the CPU 4 receives input of the reference value m and stores the reference value m in the RAM 4*a.*

Then, the CPU 4 receives an alarming timing input operation from the operation circuit 8 operated by the user and stores the alarming timing in the RAM 4*a* in step 4*h.* Then, the CPU 4 receives input of alarming mode with respect to the specified address in step st22. That is, the user can select one or more methods of the incoming alarming, namely, by the speaker 10, by the vibrator 12, or by combination of the display 7, the speaker 10, and the vibrator by operating the operation circuit 8.

Figure 4B:
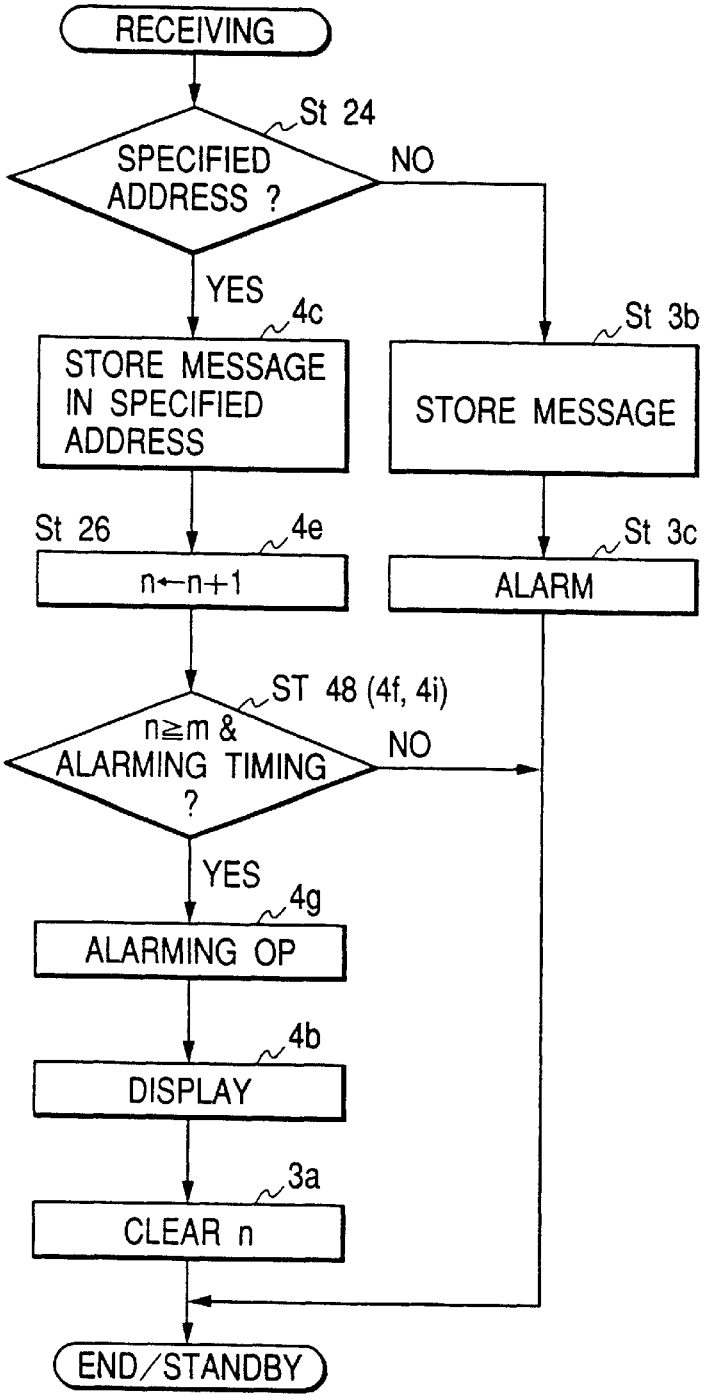
FIG. 4B depicts a flow chart of the second embodiment showing a receiving operation.

FIG. 4B depicts a flow chart of the second embodiment showing a receiving operation.

The CPU 4 executes the receiving operation as shown in FIG. 4B.

The CPU 4 Judges whether the address agrees with the specified address in step st24. If the address data disagrees with the specified address, the CPU 4 stores the message at a personal message data storing area in the RAM 4*a* by the message storing step 3*b* and controls the decoder 2 to effect alarming in the alarming step 3*c.* The decoder 2 supplies a speaker control signal to the speaker drive circuit 9 or a vibrator control signal to the vibrator drive circuit 11 The speaker drive circuit 9 drives the speaker 10 in response to the speaker control signal to generate an alarm sound if the alarming operation by the speaker 10 has been set. The vibrator drive circuit 11 drives the vibrator 12 in response to the vibrator control signal to generate vibrations if the alarming operation by the vibrator 12 has been set. After the alarming step 4*g,* the pager moves to a standby mode.

In step st24, if the address data in the decoded paging signal agrees with the specified address, the CPU 4 executes the message storing step 4*c,* that is, the CPU 4 stores the message at a predetermined storing area of the RAM 4*a* corresponding to the specified address. Then, the CPU 4 increments the number of messages directed to the specified address calculation step 4*e,* that is, the CPU 4 increases the number n of the messages directed to the specified address by one.

In the following step st48, the CPU 4 compares the number of the messages directed to the specified address with the inputted reference m stored in the RAM 4*a.* If the number of the messages directed to the specified address is not equal to or higher than the reference m and if the alarming timing has come, which is detected by comparing the clock signal from the clock circuit 2*a* with the alarming timing stored in step 4*h,* the CPU 4 moves to the standby operation without the informing operation.

In step st48, if the number of the messages directed to the specified address is equal to or higher than the reference m and if the alarming timing has come, the CPU 4 executes the alarming operation in step 4*g,* that is, the CPU 4 executes the alarming operation in the alarming mode determined in step st23. Moreover, the CPU 4 starts the timer 4*q.*

In the following step 4*b,* the CPU 4 executes the display operation, that is, when the predetermined time interval for alarming expires in the timer 4*q,* or the CPU 4 receives the display command from the operation circuit 8, the CPU 4 converts the message data into the display data and supplies the display data to the display 7. If there are a plurality of messages which have not been displayed to inform the user, the user can view all of messages directed to the specified address in response to a scroll command from the operation circuit 8. In step 3*a,* the CPU 4 clears the number n of the message directed to the specified address and moves to the standby mode.

As mentioned, if the pager according to the second embodiment receives the messages showing a low degree of immediateness or priority, a degree of the troublesomeness in responding to every alarming can be reduced. Moreover, erasing of an old message stored in the RAM 4*a* by storing a new message over the old message is prevented because of the alarming operation 4*g* controlled by the counting operation st26 and the comparing operation 4*f.* Further, the user can set the alarming timing in accordance with the daily action pattern of the user.

(Third Embodiment)

Figure 5:
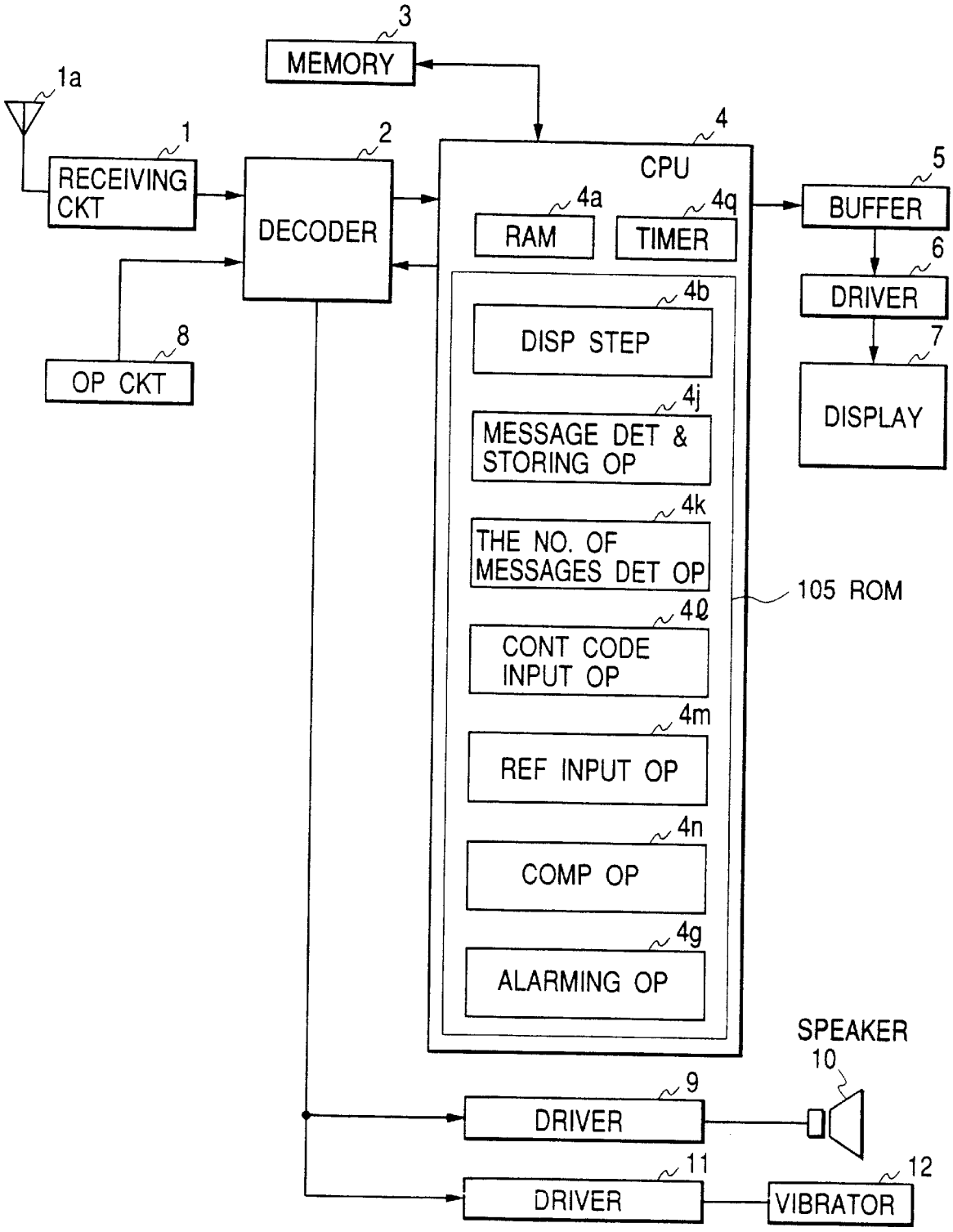
FIG. 5 is a block diagram of a pager of a third embodiment.

FIG. 5 is a block diagram of a pager of a third embodiment.

A pager of the third embodiment has substantially the same structure as that of the first embodiment. The difference is that a message detection and storing operation is further provided to detect the message showing a low degree of immediateness or priority distinguished by a control code included in the message. This controls the alarming operation. That is, the CPU 4 further in addition to the RAM 4*a,* the timer 4*q,* the displaying operation 4*b,* and the alarming operation 4*g,* the CPU 4 comprises a message detection and storing operation 4*j* for detecting the message including the control code and for storing the detected message in the RAM 4*a* at a predetermined storing area, a number of message detection operation 4*k* for detecting the number of the messages including the control code, a reference input operation 4*m* for inputting a reference m, and a comparing operation for comparing the number of the messages with the reference m.

In this embodiment, the control code includes a two-digit number and a space arranged at the top of the message for example.

Next, the controllable incoming alarming operation will be described.

Figure 6A:
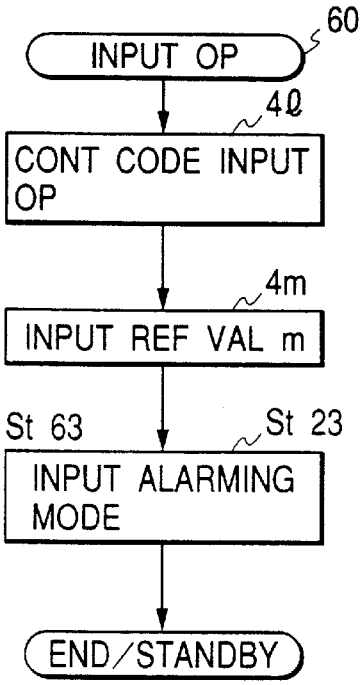
FIG. 6A depicts a flow chart of a third embodiment showing an informing mode input operation.

FIG. 6A depicts a flow chart of the third embodiment showing an alarming mode inputting operation 60.

The CPU 4 receives inputting of the control code from the operation circuit 8 operated by the user and stores the specified control code in the RAM 4*a* in step 41. Each message including the specified control code is stored at the predetermined storing area.

In the following step 4*m,* the CPU 4 receives inputting of the reference value m and stores the reference value m in the RAM 4*a*.

Then, the CPU 4 receives inputting of the alarming mode with respect to the message including the specified control code in step st23. That is, the user can select one or more methods of the alarming modes, that is, by the speaker 10, by the vibrator 12, or by combination of the display 7, the speaker 10, and the vibrator by operating the operation circuit 8.

Figure 6B:
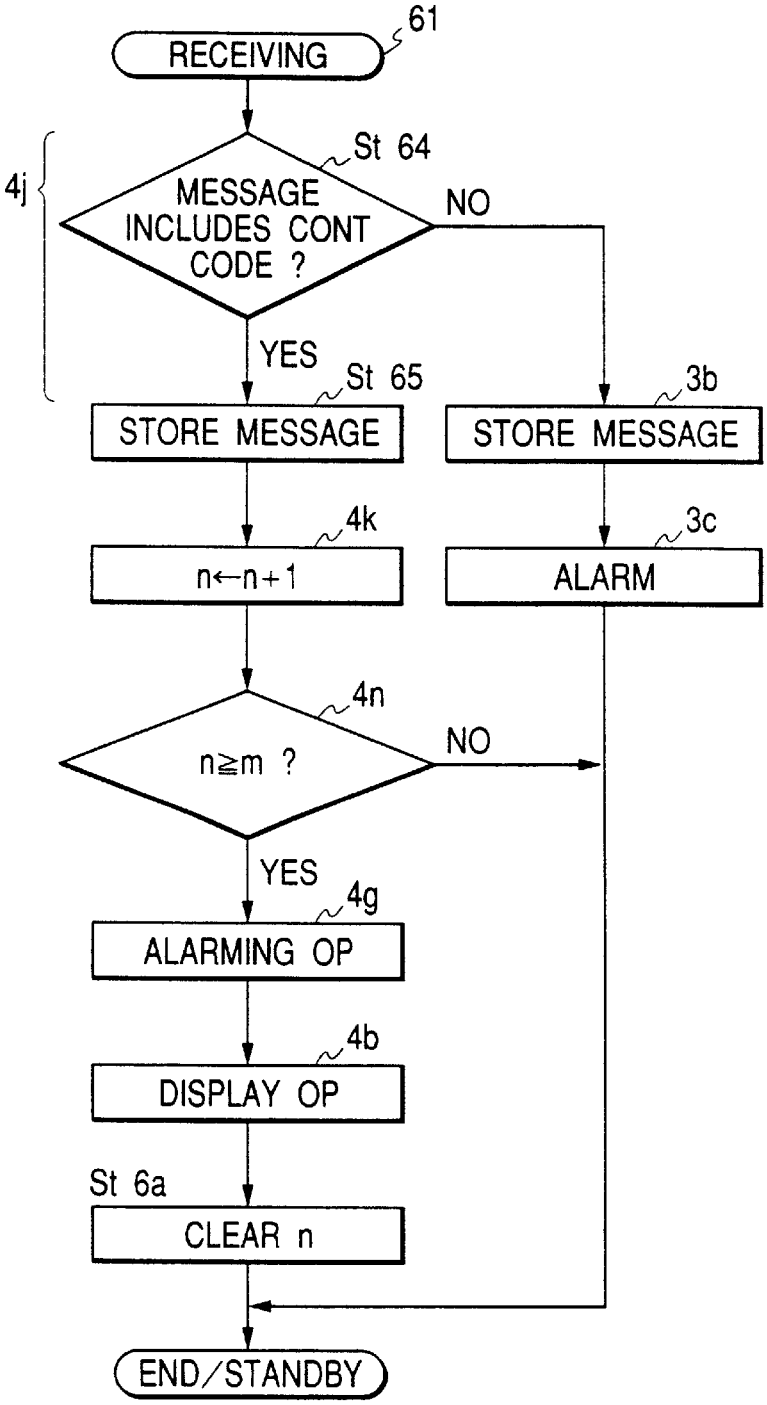
FIG. 6B depicts a flow chart of the third embodiment showing a receiving operation.

FIG. 6B depicts a flow chart of the third embodiment showing a receiving operation.

The CPU 4 executes a receiving operation as shown in FIG. 6B.

The CPU 4 Judges whether the message includes the specified control code in step st64. If the message does not include the specified control code, the CPU 4 stores the message at the personal message storing area in step 3*b* and controls the decoder 2 to effect alarming in the step 3*c*. The decoder 2 supplies a speaker control signal to the speaker drive circuit 9 or a vibrator control signal to the vibrator drive circuit 11. The speaker drive circuit 9 drives the speaker 10 in response to the speaker control signal to generate an alarm sound if the alarming operation by the speaker 10 has been set. The vibrator drive circuit 11 drives the vibrator 12 in response to the vibrator control signal to generate vibrations if the alarming operation by the vibrator 12 has been set. After the alarming step 3*c,* the pager moves to a standby mode.

In step st64, if the message includes the specified control code, that is, the message includes a control code and the control code agrees with the specified control code, the CPU 4 executes the message storing step st65, that is, the CPU 4 stores the message at a predetermined storing area of the RAM 4*a* corresponding to the specified control code. Then, the CPU 4 increments the number n of messages including the specified control code in step 4*k,* that is, the CPU 4 increases the number n of the messages including the specified control code by one.

In the following step 4*n,* the CPU 4 compares the number n of the messages including the specified control code with the inputted reference m stored in the RAM 4*a*. If the number n of the messages including the specified control code is less than the reference m, the CPU 4 moves to the standby operation without the alarming operation.

In step 4*n,* if the number of the messages including the specified control code is equal to or higher than the reference m, the CPU 4 executes the alarming operation in step 4*g,* that is, the CPU 4 executes the alarming operation in the mode determined in step st23. Moreover, the CPU 4 starts the timer 4*p*.

In the following step 4*b,* the CPU 4 executes the display operation, that is, when the predetermined time interval for alarming expires in the timer 4*q,* or the CPU 4 receives the display command from the operation circuit 8, the CPU 4 converts the message data in the predetermined storing area into the display data and supplies the display data to the display 7. If there are a plurality of messages which have not been displayed to inform the user, the user can view all of messages directed to the specified address in response to a scroll command from the operation circuit 8. In step 6*a,* the CPU 4 clears the number n of the message directed to the specified address and moves to the standby mode.

As mentioned, if the pager according to the third embodiment receives the messages showing a low degree of immediateness or priority, a degree of the troublesomeness in responding to every alarming can be reduced. Moreover, erasing of an old message stored in the RAM 4*a* by storing a new message over the old message is prevented because of the alarming operation 4*o* controlled by the counting operation in steps 4*k* and comparing operation 4*n*. Further, if the personal messages and the message showing the low degree of immediateness or priority such as broadcasted information are transmitted to the same address, it is possible to selectively store the message showing the low degree of immediateness or priority and the user can watch such message after a predetermined number of the messages have accumulated in the RAM 4*a*.

(Fourth Embodiment)

Figure 7:
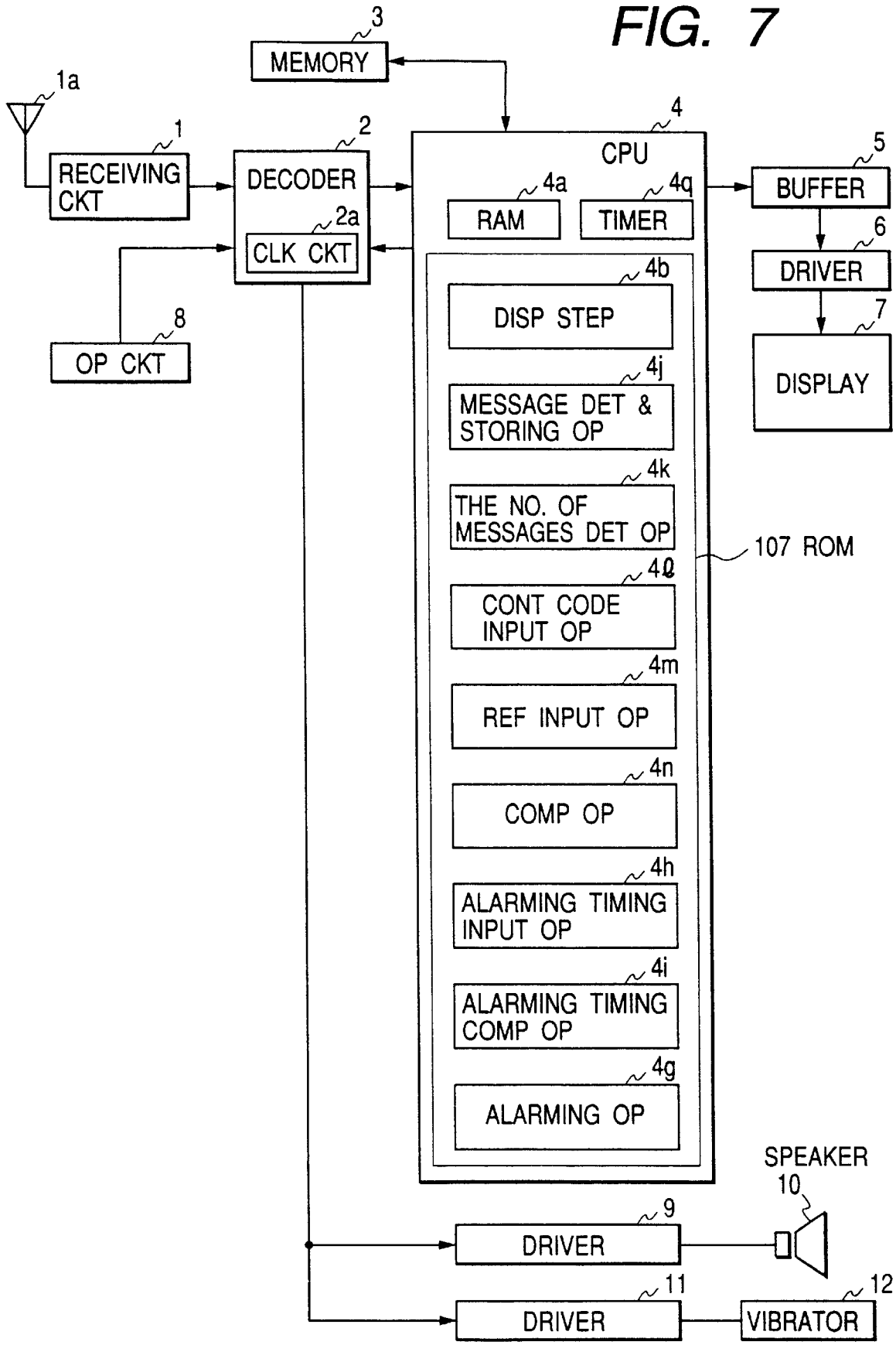
FIG. 7 is a block diagram of a pager of a fourth embodiment.

FIG. 7 is a block diagram of a pager of a fourth embodiment.

A pager of the fourth embodiment has substantially the same structure as the third embodiment. The difference is that, similarly to the second embodiment, the clock circuit 2*a* is further provided to the decoder 2 and the alarming timing input operation 4*h* and the alarming timing comparing operation 4*i* are further provided to the ROM 107 in the CPU 4. Therefore, the pager of the fourth embodiment can detect the messages, including the specified control code, showing the low degree of immediateness or priority. The messages including the specified code are stored at the predetermined storing area of the RAM 4*a* with distinction from messages not including the specified control code and the alarming is provided to the user when the desired number of messages have arrived and when the desired timing has come.

Figure 8A:
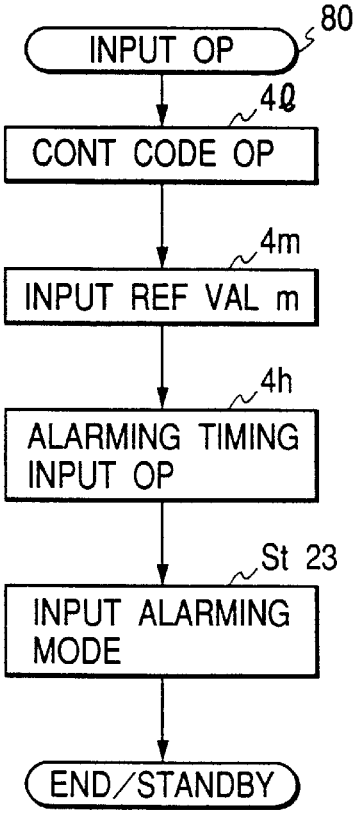
FIG. 8A depicts a flow chart of the fourth embodiment showing an input operation.

FIG. 8A depicts a flow chart of the fourth embodiment showing an input operation.

The input operation 80 of the fourth embodiment is substantially the same as the input operation 60 of the third embodiment. The difference is that the alarming timing input operation 4*h* and the step of inputting the alarming mode described in the second embodiment are further executed.

Figure 8B:
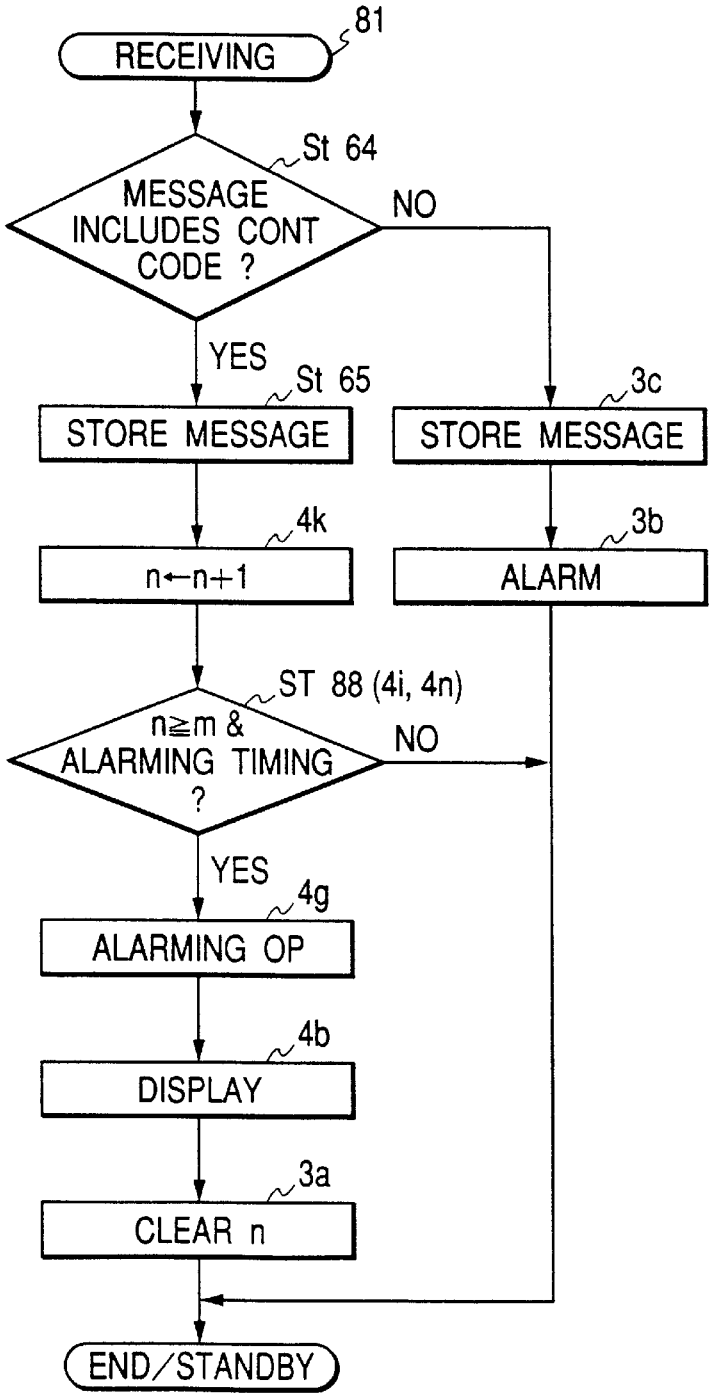
FIG. 8B depicts a flow chart of the fourth embodiment showing,a receiving operation.
Figure 9:
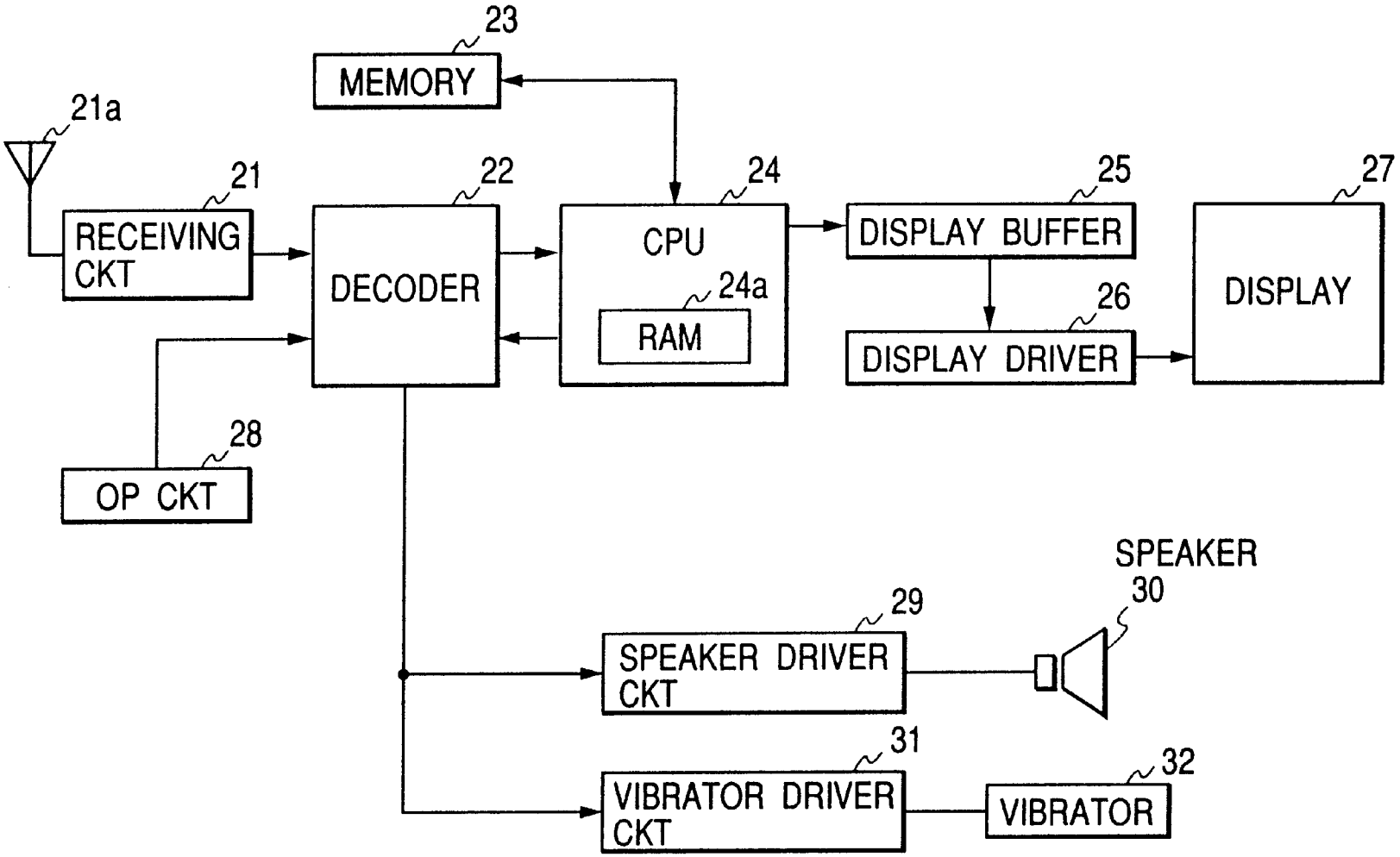
FIG. 9 PRIOR ART
FIG. 9 is a block diagram of a prior art pager.

FIG. 8B depicts a flow chart of the fourth embodiment showing a receiving operation 81.

The receiving operation 81 of the fourth embodiment is substantially the same as the receiving operation 61 of the third embodiment. The difference is that the comparing step st88 is used. That is, the number of the messages including the specified control code is compared with the reference m and the inputted alarming timing is compared with the present time indicated by the clock signal from the clock circuit 2*a*.

More specifically, though the number of the messages including the specified control code is lower than the reference m, if the present time does not reach the alarming timing set in the alarming timing input operation 4*h,* the alarming is not effected and moves to the standby mode. If the number of the messages including the specified control code is not lower than the reference m, and the present time reaches the alarming timing set in the alarming timing input operation 4*h,* the alarming is effected.

As mentioned, if the pager of the fourth embodiment receives the messages showing a low degree of immediateness or priority, a degree of the troublesomeness in responding to every alarming can be reduced. Further, if the personal messages and the message showing the low degree of immediateness or priority such as broadcasted information are transmitted to the same address, it is possible to selectively store the messages showing the low degree of immediateness or priority and the user can watch such messages after a predetermined number of the messages accumulated in the RAM 4*a* at a desired timing.

What is claimed is:

1. A message receiving apparatus comprising:

receiving means for receiving a transmitted signal including a message and address data;

message receiving means responsive to said receiving means, having address storing means for storing a plurality of sets of assigned address data, and further having message storage means, for receiving and storing said message from said receiving means in said message storing means when said address data in said received transmitted signal agrees with any of said plurality of sets of assigned address data;

message informing means responsive to a command signal for reading said message from said message storing means and informing an operator of the read message;

counting means for counting the number of times of receiving said message when said address data in said received transmitted signal agrees with one of said plurality of sets of assigned address data;

comparing means responsive to said counting means for comparing said number of times with a reference; and alarming means for effecting an alarming operation on the basis of the result of said comparing means.

2. The message receiving apparatus as claimed in claim 1, wherein said alarming means effects said alarming operation when said number of times is equal to or higher than said reference.

3. The message receiving apparatus as claimed in claim 1, further comprising time signal generation means for generating a time signal indicative of the present time and timing detection means for detecting that the present time agrees with a predetermined time, wherein said alarming means effects said alarming operation on the basis of the result of said comparing means and the result of said timing detection means.

4. A message receiving apparatus comprising:

receiving means for receiving a transmitted signal including a message and address data, said message including a control code indicative of a kind of said message;

message receiving means responsive to said receiving means, having address storing means for storing assigned address data and further having message storing means, for receiving and storing said message from said receiving means in said message storing means when said address data in said received transmitted signal agrees with said assigned address data;

control code detection means for detecting said control code form said message in the received transmitted signal;

message informing means responsive to a command signal for reading said message from said message storing means and informing an operator of the read message;

counting means responsive to said message receiving means for counting the number of times of receiving said message which includes said detected control code agreeing with a predetermined control code;

comparing means responsive to said counting means for comparing said number of times with a reference; and alarming means for effecting an alarming operation on the basis of the result of said comparing means.

5. A message receiving apparatus as claimed in claim 4, wherein said alarming means effects said informing operation when said number of times is equal to or higher than said reference.

6. A message receiving apparatus as claimed in claim 4, further comprising time signal generation means for generating a time signal indicative of the present time and timing detection means for detecting that the present time agrees with a predetermined time, wherein said alarming means effects said alarming operation on the basis of the result of said comparing means and the result of said timing detection means.

7. A method of receiving a message from a transmitted signal, comprising the steps of:

(a) providing an address memory for storing a plurality of sets of assigned address data, and a message memory;

(b) receiving a transmitted signal including a message and address data of said message;

(c) receiving and storing said message from said received transmitted signal in said message memory when said address data agrees with any of said plurality of sets of assigned address data in response to said step (b);

(d) reading said message from said message memory and informing an operator of the read message in response to a command signal;

(e) counting the number of times of receiving said message when said address data of said message agrees with one of said plurality of sets of assigned address data;

(f) comparing said number of times with a reference in response to said step (e); and (g) effecting an alarming operation on the basis of the result in step (f).

8. The method as claimed in claim 7, wherein said informing operation is effected when said number of times is equal to or higher than said reference.

9. The method as claimed in claim 7, further comprising the steps of:

(h) generating a time signal indicative of the present time; and (i) detecting that the present time agrees with a predetermined time, wherein said alarming operation is effected on the basis of the result of said step (f) and the result of step (i).

10. A method of receiving a message from a transmitted signal, comprising the steps of:

(a) providing an address memory for storing assigned address data and a message memory;

(b) receiving a transmitted signal, including a message and address data of said message, said message including a control code indicative of a kind of said message;

(c) receiving and storing said message from said received transmitted signal in said message memory when said address data of said message agrees with said assigned address data in response to said step (b);

(d) detecting said control code from said message;

(e) reading said message from said message memory and informing an operator of the read message in response to a command signal;

(f) counting the number of times of receiving said message which includes said detected control code agreeing with a predetermined control code;

(g) comparing said number of times with a reference in response to said step (f); and (h) effecting an alarming operation on the basis of the result in step (g).

11. The method as claimed in claim 10, wherein said alarming operation is effected when said number of times is equal to or higher than said reference.

12. The method as claimed in claim 10, further comprising the steps of:

(i) generating a time signal indicative of the present time; and (j) detecting that the present time agrees with a predetermined time, wherein said informing operation is effected on the basis of the result of said step (g) and the result of said step (j).

* * * * *